US005189909A

United States Patent [19]

Oike et al.

[11] Patent Number: 5,189,909

[45] Date of Patent: Mar. 2, 1993

[54] DEVICE FOR MEASURING PROPERTIES OF UNDERGROUND WATER AND METHOD THEREFOR

[75] Inventors: Takayasu Oike; Kazuhiko Endoh; Takashi Suzuki; Kazuhiro Watanabe; Hirochika Suzuki, all of Yokohama; Jun Shimada, Tsukuba; Takashi Ishii, Tokyo; Tateo Adachi, Tokyo; Yoshihiro Horie, Tokyo, all of Japan

[73] Assignees: The Tsurumi-Seiki Co., Ltd., Kanagawa; Shimizu Construction Co., Ltd., Tokyo, both of Japan

[21] Appl. No.: 563,244

[22] Filed: Aug. 6, 1990

[30] Foreign Application Priority Data

Aug. 7, 1989 [JP] Japan ..... 1-204284
Aug. 7, 1989 [JP] Japan ..... 1-204285

[51] Int. Cl.[5] ..... E21B 49/08; E21B 47/00

[52] U.S. Cl. ..... 73/155; 73/152; 166/264

[58] Field of Search ..... 73/152, 155; 364/413.31; 166/264

[56] References Cited

U.S. PATENT DOCUMENTS

| | | | |
|---|---|---|---|
| 2,473,713 | 6/1949 | Kingston et al. | 73/152 |
| 2,607,220 | 8/1952 | Martin | 73/152 |
| 2,674,126 | 4/1954 | Coberly | 73/155 |
| 3,079,793 | 3/1963 | Le Bus et al. | 73/152 |
| 3,113,455 | 12/1963 | Sloan et al. | 73/155 |
| 3,721,960 | 3/1973 | Tinch et al. | 73/152 |
| 3,992,948 | 11/1976 | D'Antonio et al. | 364/413.31 |
| 4,338,664 | 7/1982 | Mayer | 73/152 |
| 4,416,494 | 11/1983 | Watkins et al. | 73/152 |
| 4,545,242 | 10/1985 | Chan | 73/152 |
| 4,893,505 | 1/1990 | Marsden et al. | 73/155 |

OTHER PUBLICATIONS

J. D. Ross and B. W. Graham, *A Borehole Methodology for Hydrogeochemical Investigations in Fractured Rock,* Water Resources Research, vol. 20, No. 9, pp. 1277-1300, Sep. 1984.

*Primary Examiner*—Hezron E. Williams
*Assistant Examiner*—George Dombroske
*Attorney, Agent, or Firm*—Scully, Scott, Murphy & Presser

[57] ABSTRACT

An apparatus and method for measuring the properties of underground water are disclosed. The device comprises a measuring apparatus with a measuring sensor for measuring the properties of the underground water, a pair of expandable and contractible packers arranged above and below the measuring apparatus, a transmitting means for sending measurement signals from the measuring apparatus, and a receiving means located at the ground surface for receiving the measurement signals from the transmitting apparatus. The method of the present invention comprises the steps of placing a measurement apparatus with a measuring sensor in a bored hole at a desired depth, arranging a pair of packers so that the measuring sensor is interposed therebetween, pumping water to the ground surface from the space between the two packers, and comparing the properties of the water pumped to the surface with the properties of the water measured with the above-mentioned measuring sensor.

8 Claims, 8 Drawing Sheets

DEVICE FOR MEASURING PROPERTIES OF UNDERGROUND WATER AND METHOD THEREFOR

BACKGROUND OF THE INVENTION

The present invention generally relates to a device and a method for measuring properties of underground water, the device being inserted into an excavation hole, such as a boring hole excavated underground. More particularly, this invention relates to a device and a method for measuring properties of underground water which is capable of precisely measuring water properties over an extended period of time.

In assessing the safety of a structure built deep underground, a survey of underground water flowing around the structure is indispensable. For this reason, a number of boring holes are drilled into the ground around the structure to provide measuring points at which various properties of the underground water can be measured over an extended period of time. Therefore, various conventional means have been proposed and carried out to measure the properties of the underground water. One method to obtain such measurements is to sample underground water in the bored hole from a sampling opening fixed in the bored hole between a pair of packers. The various properties of the sampled water are measured by a sensor placed on the surface of the ground. Alternately, a casing is inserted in the bored hole fixed by a plurality of packers and a sensor is placed in the casing to measure the various properties within the bored hole.

With conventional methods in which the water sampling opening is disposed in the bored hole, the water partioned between an adjacent pair of packers may become mixed with water originating at location above the sampling location which was introduced during installation of the apparatus. Thus, such methods require a prolonged equilibration period over which the water at a given location is continuously sampled until it becomes identical with the water produced at that location. For this reason, sample water obtained for up to three days after installation of the apparatus cannot be used for generation of data. It is therefore necessary to continuously monitor the obtained water samples until it is determined that an equilibrium state has been reached at which the obtained water sample are equivalent to the water that enters the hole at that level. This type of method, however, has the following problems:

(1) Even if the hole is partitioned by two packers and the water is sampled on a continuous basis, the water present in the space partitioned by the packers at the time of installation may not be completely displaced. Some of the old water may remain, thus making it uncertain whether the sampled water represents actual underground water from that level, even though the water from that level is subjected to monitoring by a water quality sensor.

(2) When a pump is pumping up water at a constant rate, the underground water pressure in the space partitioned by the packers rapidly falls if the pumping rate is faster than the supply rate of water from the surrounding ground, causing the level of $O_2$ and $CO_2$ dissolved in the underground water to change their values and thereby distorting the measured values for the water's properties.

(3) If the underground water is rich in sulfides, these constituents will deposit, precipitate on, or corrode the electrodes of a pH sensor or an oxidation reduced potential sensor, also resulting in distorted measurements.

(4) The determined value of the sampling position is not entirely dependable.

(5) Because the device is quite long, it is difficult to smoothly insert the apparatus into a hole if the hole is not straight.

In the conventional measuring device of a method that fixes a casing in the bored hole, it is difficult to use a casing with optional diameters because a specific casing diameter must be used. It is also impossible to use a conventional device capable of continuous sampling because the space inside the casing is small. Moreover, it is impossible to sample the water continuously and in large volume because a sampling bottle must be lowered into the small space and the samples must be taken one bottle at a time. In addition, a sample characteristic such as water temperature may change before it is measured above the ground.

SUMMARY OF THE INVENTION

The present invention provides a device which is inserted in a bored hole to measure properties of the underground water in the bored hole. This device comprises a measuring means with a measuring sensor for measuring the properties of the underground water, a pair of expandable and contractible packers arranged above and below said measuring means respectively, a transmitting means for sending measurement signals from the measuring means, and a receiving means arranged on the ground for receiving said measurement signals from the transmitting means.

In a preferred embodiment of the present invention, the device also comprises a water pump for pumping up to the ground surface the underground water flowing into the area partitioned by the packers. It is also preferable to use a pressure sensor that reads the water pressure around the water pump and a control means to control the driving rate of this water pump according to a detection signal from the pressure sensor.

In another preferred embodiment of the present invention, the device also comprises a bending means which can be bent in every direction. A washing mechanism may also be used in order to wash the surface of the measuring sensor that measures water properties.

Still another preferred embodiment of the present invention has a second measuring means in the device that measures the properties of the underground water pumped up by the water pump.

Furthermore, the measuring means, the packers and the transmitting means can be suspended by the same cable. It is best to use a cable measuring means to measure the length of the cable extending from the ground surface to the measuring means.

In addition, the water pump can comprise a cylinder, a waterproof piston moving in said cylinder, and a suction/discharge mechanism on both ends of the cylinder. In this case, the suction/discharge mechanism uses a suction stop valve coupled to the inside of the cylinder which opens externally only when the piston draws a vacuum. A discharge stop valve is also coupled to the inside of the cylinder which opens externally only when the piston generates an increased pressure.

Also, the present invention provides a method for measuring properties of underground water in a bored hole, which is comprised of the steps of placing a measuring means with a measuring sensor, a pair of expandable and contractible packers arranged above and below the measuring part respectively, and a water pump used to pump up the underground water flowing into the area partitioned by the packers in the bored hole, and determining the properties of the underground water by comparing measurement signals from said measuring sensor with those of the underground water pumped up by the pump.

Similarly, the present invention provides a method for measuring properties of underground water in a bored hole, which is comprised of the steps of placing a measuring means with a measuring sensor, a pair of expandable and contractible packers arranged above and below the measuring part respectively, and a water pump used to pump up the underground water flowing into the area partitioned by the packers in the bored hole, and determining the depth position of the measuring means by comparing a pressure data from a pressure sensor arranged by the measuring part with cable length data obtained from measuring the length of the cable extending from the ground surface to the measuring means.

According to the device of the present invention, the packers arranged above and below the measuring part are contracted in order to make the diameter of the device small enough to fit in the bored hole. Under this condition, the packers are radially expanded in the predetermined position to press against the wall of the bored hole. This repulsing force supports the device, thus enabling the measuring means to measure the properties of the underground water between the packers. The measurement signal detected by the measuring means is sent to the surface by the transmitting means. Therefore, once the device is placed in the bored hole, the properties of the underground water in that position can be measured directly and accurately. Highly accurate figures for water temperature and pH can be obtained because of the device's ability to make direct measurements. Moreover, the use of expandable and contractible packers that fix the device in the bored hole permits reliable measurement regardless of the bored hole's diameter.

The properties detected in the bored hole are compared to those measured after the water has been pumped up by the pump, after which the discrepancies in the water properties can easily provide exact values.

Similarly, according the method of the present invention, the pressure data detected by the pressure sensor is compared to the cable length, after which the differences in the data easily provide exact values.

DETAILED DESCRIPTION OF THE PREFERRED EMBODIMENTS

Figure 1:
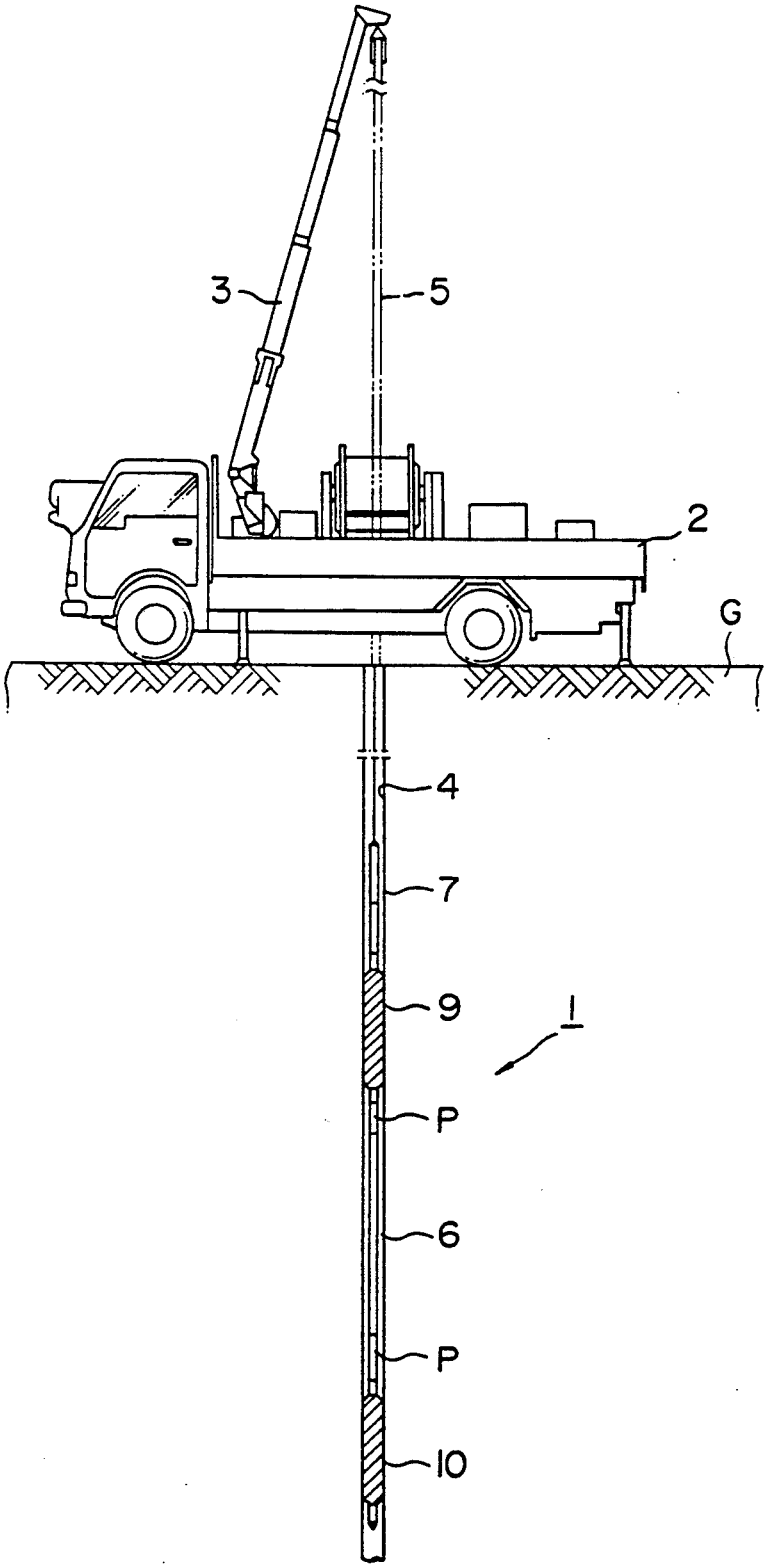
FIG. 1 is a cross-sectional drawing of the entire configuration of a device of the first embodiment of the present invention.

Explanations are given for the embodiments of the present invention with reference to the drawings.

FIGS. 1 through 5 are drawings of the device of the first embodiment of the present invention. In these figures, the part represented entirely by a reference numeral "1" is the device for measuring properties of underground water (hereinafter referred to as the "measuring device"), the measuring device 1 being formed entirely of a thin rod and a wire 5 suspended from a turret on a vehicle 2 into boring holes 4 drilled vertically into the ground G. The boring holes 4 are drilled around structures built in the ground (not shown in the figures), with the depth of one boring hole 4 reaching approximately 1000 meters.

The measuring device 1 roughly comprises, as shown in FIG. 1, measuring parts 6 containing various sensors to measure underground water properties, a water pump 7 on the upper part of the measuring part 6, an upper packer 9 and lower packer 10 in lower part of the pump 7 and in the lower part of the measuring part 6, respectively, and a flexible pipe P that is bendable in every direction and that interposes between the upper and lower packers 9, 10 and the measuring part 6 to make these parts flexible, the pipe being connected to them coaxially. The measuring device 1 has a means to control the measuring part 6, pump 7 and upper and lower packers 9, 10, as well as to memorize various properties measured by the measuring part 6.

Figure 2:
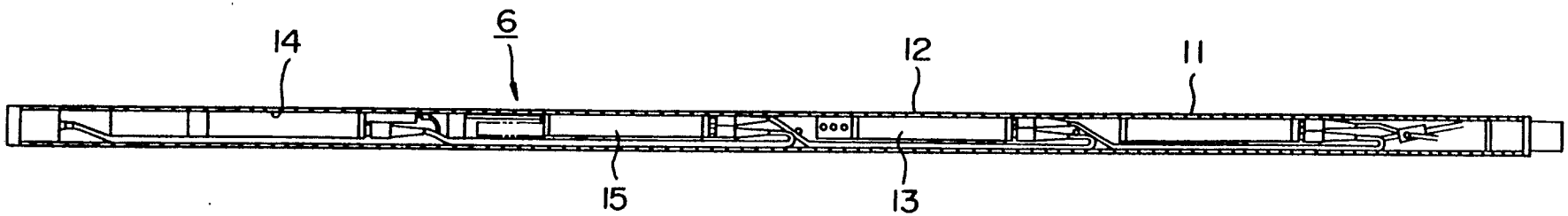
FIG. 2 is a cross-sectional drawing of the configuration of the measuring means in the above embodiment.

The measuring part 6 comprises, as shown in FIG. 2, a pressure measuring part 11, a water temperature measuring part 12, a conductivity measuring part 13, a pH measuring part 14 and an oxidation reduced potential (Eh) measuring part 15. The structure of parts 11 through 15 in each measuring part is approximately identical, and these parts are housed in a cylindrical casing with a water sampling opening. A sensor protrudes, from the pressure resistant case housing the circuits, and the circuits are connected by a cable to supply common DC power and signals (not shown in the figure). Therefore, an explanation follows only for the conductivity measuring part 13. This embodiment has a casing halved along its axial direction, and circuit and sensor is fixed in one of the halved casings. The circuit contains a control circuit that can make measurements by means of remote-control signals from the ground surface, as well by frequency modulation (FM) of the various properties measured by the sensor and transmission of the DC power superimposed on the cable.

Figure 3:
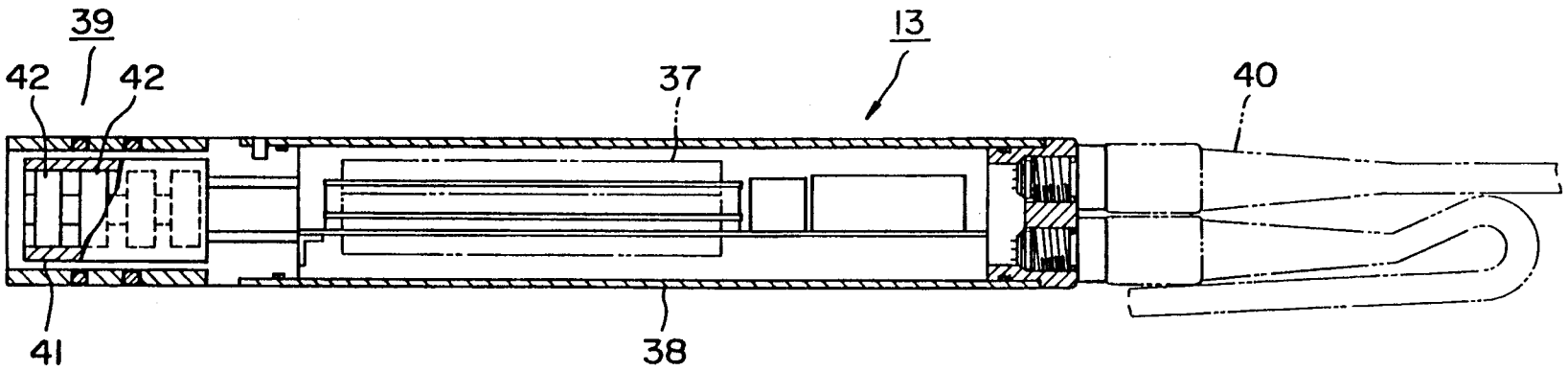
FIG. 3 is a cross-sectional drawing of the conductivity measuring part in the above embodiment.

The conductivity measuring part 13 comprises, as shown in FIG. 3, the pressure resistant case 38 housing a circuit 37, the sensor 39 protruding from the pressure resistant case 38, and the DC power cable 40 commonly connected to this circuit. The sensor 39 is a "liquid conductivity" sensor using electromagnetic induction having four ring-shaped cores 42 made of magnetic permeable material (such as Permalloy) arranged in a column-shaped case 41 made of non-conductive and non-magnetic material, with the cores being axially aligned. Further, a through-hole 43 is drilled on the case 41 such that the hole pierces the center opening on the core 42. The cores 42, . . . are wound with conductors (not shown in the figure) to form coils. These four coils function alternatingly as a primary coil and secondary coil, respectively, and are connected to an oscillator and an amplifier in the circuit. Therefore, AC voltage is applied to the primary coil by means of the circuit oscillator. A current proportionate to the conductivity of the underground water is generated by electromagnetic induction in a loop formed by the underground water in the primary coil, the secondary coil, the through-hole 43, and the underground water surrounding the sensor 39. The current is detected as a voltage signal by the secondary coil, thus enabling the measurement of conductivity of the underground water in the through-hole 43.

Because of the four cores (or coils) 42 in the conductivity measuring sensor 39, a substance with such low conductivity as in underground water can be measured with high accuracy, and the entire structure is compact. To explain, the ordinary conductivity sensor using electromagnetic induction has one primary coil and one secondary coil, and because the sensor measures conductivity by means of a voltage, the secondary coil voltage becomes low when measuring a substance with low conductivity such as underground water.

Therefore, in order to improve the accuracy of conductivity measurement, saturation flux in the primary coil must be raised and the number of secondary coil windings must be increased. Any attempt to improve the configuration by using two coils will result in a larger outer diameter, making it difficult to use in such a narrow space as found in the boring hole 4. Therefore, this embodiment improves the accuracy of the conductivity measurement by using four coils instead of increasing the outer diameter of the sensor 39, thus making it possible to measure the conductivity of the underground water in the boring hole 4.

Figure 4:
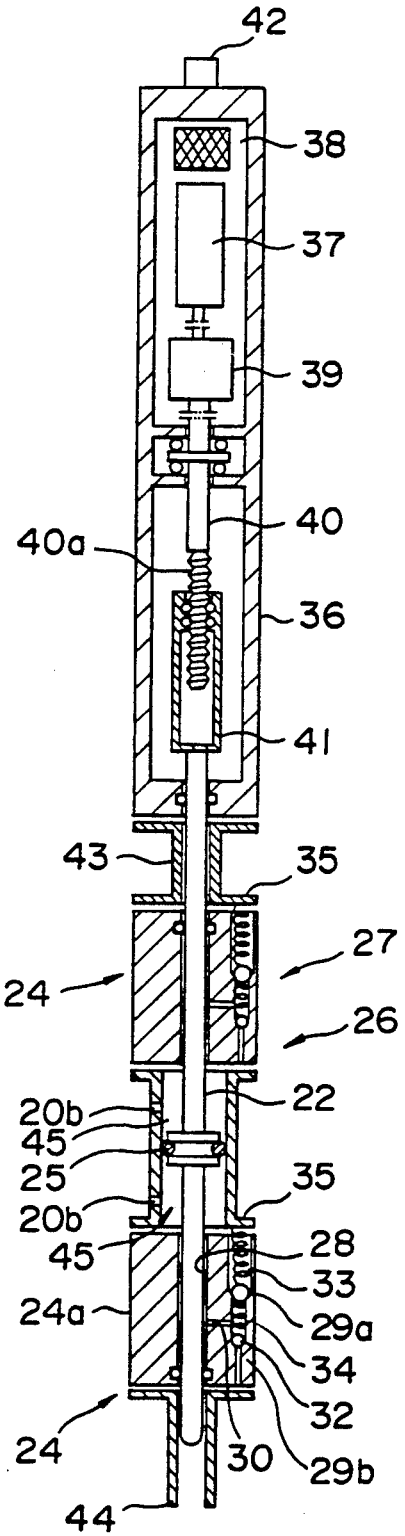
FIG. 4 is a cross sectional drawing of the water pump in the above embodiment.

The pump 7 roughly comprises, as shown in FIG. 4, a cylinder 20 with both ends open, a disc-shaped, waterproof piston 21 in the cylinder 20, piston rods 22 protruding from both ends of the piston 21, a driving mechanism 23 to move the piston 21 in the cylinder 20 by moving one of the piston rod 22 in the axial direction, and suction/discharge mechanisms 24 disposed on both ends of the cylinder 20.

The cylinder 20 has both its ends bent outwardly to form flanges 20*a*. The flanges 20*a* are the fixing points of the suction/discharge mechanisms 24. The side wall of the cylinder 20 has through-holes 20*b* drilled as a link to the inside of the cylinder, and the holes are used to vent air at the start of the pump 7 operation. The piston 21 is formed by a disc member with a slightly smaller diameter than the inner diameter of the cylinder 20. The piston also has a groove with a cylindrical cross-section that is fitted with an O-ring (to retain liquid) attached to the inner side of the cylinder 21. Further, the piston rods 22 extend along the axial direction of the cylinder 20 from the center of both ends of the piston 21 and pass through the suction/discharge mechanisms 24.

This suction/discharge mechanism 24 is structured with a suction stop valve 26 and a discharge stop valve 27 arranged coaxially in the main body 24*a* of the mechanism and has a column-shaped outline. The main body 24*a* has a through-hole 28 slightly larger in diameter than the piston rod 22 drilled in its center, as well as a through-hole 29 in a position slightly off the axial line. The through-hole 29 is structured in three steps so that its diameter becomes smaller as it goes downward, with the pump 7 arranged in the boring hole 4. The through-hole 29 is formed in its middle section with a linking hole 30 that is linked with the through-hole 28 in the center of the main body 24. Each step 29*a*, 29*b* of the through-hole 29 is arranged with balls 31, 32 that fit the steps, and springs 33, 34 are arranged above the balls 31, 32 in the through-hole 29 to press the balls 31, 32 downward, thus constructing the suction stop valve 26 and the discharge stop valve 27. In this embodiment, the stop valve located in the upper part of the suction/discharge mechanism 24 works as the discharge stop valve 27, and the stop valve located in the lower part works as the suction stop valve 26. The suction stop valve 26 has its end opened externally by the various sensors of the measuring part 6, and the discharge stop valve 27 has its open end connected with a pressure pipe 35, of which the tip is led to a water-quality measuring meter located above the ground. The through-hole 29 in the center of the main body 20 has a sealing material 29*a* interposed between the piston rods 22 to maintain water tightness.

The driving mechanism 23 coupled to the piston rod 22 is housed in a waterproof and pressure resistant casing 36. The driving mechanism 23 roughly comprises a motor 37 as the powering source, a control circuit 38 to supply power to the motor 37 in accordance with remote-controlled operating signals from the ground surface, a reduction gear 39 coupled to an output terminal of the motor 37, a rotation shaft 40 which is an output terminal of the reduction gear 39, a screw 41 associated with screw 40*a* at the tip of the rotation shaft 40 and coupled to the tip of the piston rod 22.

In FIG. 4, the reference numeral "42" is an underwater connector to which the power supply is connected, the numeral "43" is a coupling member to couple the casing 36 with the suction/discharge mechanism 24 located in the upper position, the numeral "44" is a rod cover on the lower tip of the suction/discharge mechanism 24 located in the lower position, and a through-hole (not shown) is drilled in a position where the coupling member "43" and the rod cover "44" are open to the open ends of the stop valves 26, 27. Similarly, a through-hole (not shown) is drilled in a position where the cylinder 20 is open to the open ends of the stop valves 26, 27.

The upper packer 9 and the lower packer 10 roughly comprise expandable and contractible bag bodies, and an injection mechanism to inject water into the bag bodies (both not shown).

Further, the flexible pipe P is a pipe made of resilient, deformable material and is structured to be bendable in all directions.

Next, a method is described for measuring the properties of underground water in the boring hole 4 using the underground water measuring device as described above, referring to FIG. 1.

First, boring holes 4 are drilled around a structure to be built underground (not shown in the figure) using boring equipment. In this case, the boring equipment to drill the boring holes 4 need not be special.

Next, the measuring part 6, the pump 7, the upper and lower packers 9, 10, and the flexible pipe P are coupled to form the underground water measuring device 1, which is lifted up by the turret 3 using the wire 5, and then slowly lowered into the bored hole 4. When the measuring device 1 reaches a depth for measurement, the upper and lower packers are expanded by injecting water into them until they contact the inner wall of the bored hole 4. This fixes the entire measuring device 1 in the bored hole.

In this condition the pump 7 starts to sample the underground water where the measuring device 1 is located. That is, after the pump 7 is installed, the motor 37 is driven by the control circuit 38 according to commands from the ground surface. The driving force of the motor 37 is reduced in the reduction gear 39, transmitted to the rotation shaft 40 as its rotation force, and converted into linear motion by coupling the screw 40*a* and the screw section 41 on the tip of the rotation shaft 40 to move the piston rod 22.

Associated with the motion of the piston rod 22, the piston 21 moves in the cylinder 20, and thus the underground water around the measuring part 6 is sampled. To explain specifically, cylinder chambers 45 formed above and below the piston 21 repeat contraction and expansion because of the reciprocal motion of the piston 21. Underground water then flows into the expanded cylinder chamber 45 through the suction stop valve 26, the linking hole 30, and the clearance between the main body 24*a* and the through-hole 28, to fill the cylinder chamber 45 with the underground water. Then, as the cylinder chamber is filled with the underground water, the water is brought to the discharge stop valve 27 through the clearance between the main body 24*a* and the through-hole 28, and the linking-hole 30, and sent under pressure form this stop valve 27 toward the pressure pipe 35. Therefore, the underground water around the measuring part 6 is placed under pressure because of the reciprocal motion of the piston 21 and sent to the water-quality monitor above the ground through the pressure pipe 35, where various properties are measured using this water-quality monitor.

At the same time, the underground water is sampled by the pump 7 through the measuring part 6, and the properties of underground water is measured by the measuring part 6. First, remote operation signals are sent to the specified measuring parts 11 through 15, where water property measurements are carried out. The properties measured in the measuring parts 11 through 15 undergo frequency modulation by the control circuits located in the circuit sections in the measuring parts 11 through 15, and are then transmitted to the ground surface by the cable superimposed with DC power.

Commands and property values are transmitted by remote control/operation signals. The measuring parts 11 through 15 have their inherent call frequency, and the control means provided on the ground sends out frequency signals corresponding to any of the measuring parts 11 through 15 to be operated. Signals travel along the cable superimposed with DC power to poll (call) the measuring parts Il through 15. The measuring parts 11 through 15 called in turn send the property values measured by the sensor in a frequency-modulated form. Each property value is assigned a specific frequency band, and the property values are sent in a range corresponding to the band width. In this case, the frequency band for sending the property values may be set in duplication, unless more than one measuring part 11 through 15 is called simultaneously, and can be determined appropriately taking the cable characteristic into consideration.

After the underground water properties are measured over a predetermined period of time, the upper and lower packers are contracted, and the measuring device is pulled out from the bored hole 4 and inserted into another bored hole 4. In this way, the properties of the underground water around the structure are measured.

Figure 5:
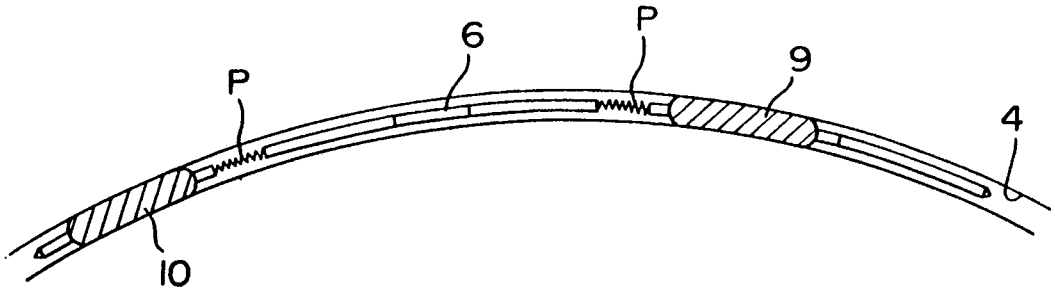
FIG. 5 is an illustration of how the device of the above embodiment is used.

Therefore, because the measuring device 1 in this embodiment has a measuring part 6 equipped with a sensor between the upper and lower packers 9, 10, the property values of underground water can be directly measured once the measuring device 1 is inserted into the bored hole 4, and measurement errors will be small. Moreover, because the measuring device 1 is securely installed in the bored hole 4 by means of expandable packers 9, 10, a reliable measurement can be made regardless of the diameter of the bored hole 4 Also, as shown in FIG. 5, if the hole into which the measuring device 1 is to be inserted is bent, the flexible pipe P bends to accommodate the entire measuring device according to the hole's shape, thus permitting the measuring device 1 to be inserted into bored holes 4 of any shape.

Furthermore, the pump 7 in this embodiment with the suction/discharge mechanisms 24 on both ends of the cylinder 20 differs from conventional pumps in that it can send underground water under pressure through reciprocal cycles of the piston 21, and can sufficiently elevate the pressure transmitting efficiency. This makes it possible to sample underground water from a great depth of approximately 1000 meters or more. The pump 7 also maintain the transmitting capacity even if the outer diameter of the cylinder 20 is so small that it fits into boring holes of small diameter (abut 50 mm). In addition, if a bored hole has no bend, the flexible pipe P may be omitted.

Figure 6:
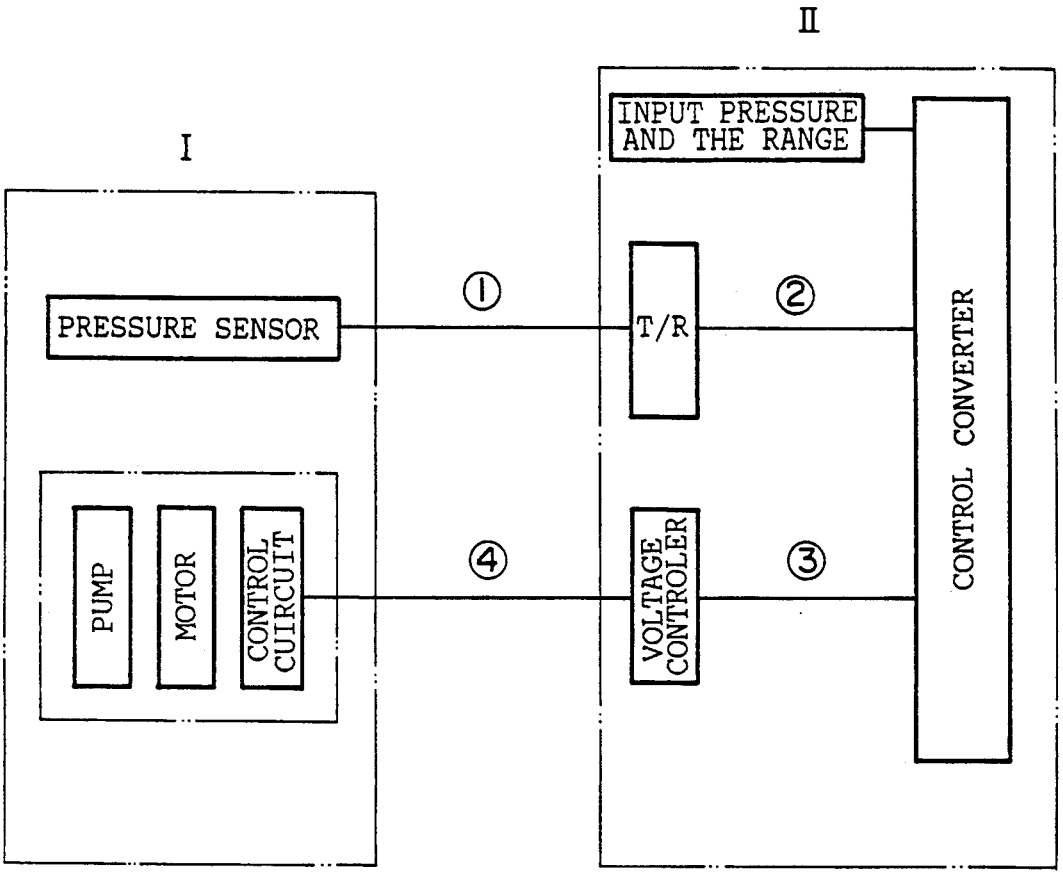
FIG. 6 is a drawing of the device of a second embodiment of the present invention. This drawing summarizes the control system governing the pumping rate.
Figure 7:
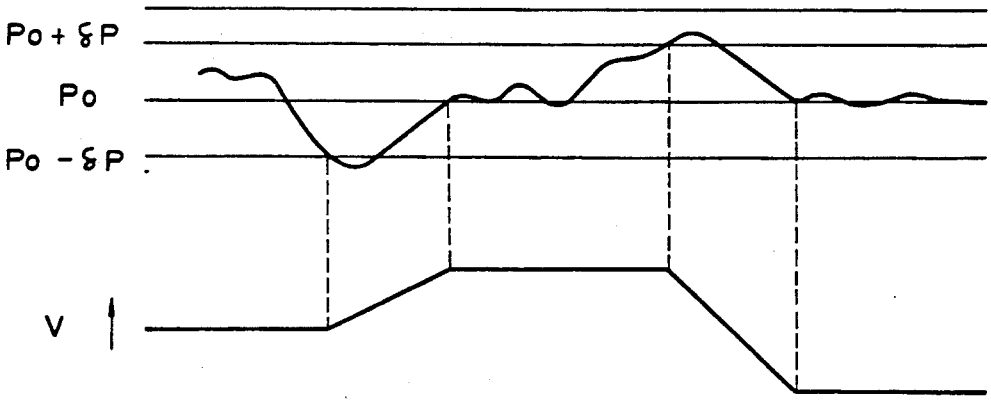
FIG. 7 is an illustration of how the system of the second embodiment is controlled.

Next, FIGS. 6 and 7 show a second embodiment of the present invention, a device for measuring the properties of underground water. In the ensuing explanation, the same components as in the above first embodiment are given identical reference numerals.

The measuring device in this embodiment is structured so that in addition to including the measuring device in the first embodiment, it has a pressure sensor 11 to detect water pressure around the pump 7, and a control device to control the driving rate of the pump 7 according to a detection signal detected by the pressure sensor 11.

In FIG. 6, the reference letter "A" indicates the control system arranged in the bored hole 4, and "B" indicates the control system located at ground level.

Control system A has a pressure sensor 11 to detect underground water pressure in the bored hole 4, a pump 7, a motor to drive the pump 7, and a control circuit to control the driving rate of the motor.

Control system B has a transmitter and receiver to receive the detection signal ① from the pressure sensor 11, a control converter to receive the pressure signal ② and to calculate an optimum driving rate for the pump 7, and a voltage controller to receive the conversion signal ③ from the control converter and to transmit the drive data ④ to the control circuit in the bored hole 4. The control converter consists of a personal computer, a display device such as a CRT or LCD (liquid crystal display), a printer, and an input keyboard. The pump drive motor 37 is driven by a DC voltage supplied from the voltage control part through a cable.

In the measuring device 1 equipped with the control system, a central value and the permissible variation range of the pressure are input from the keyboard of the control converter before the measuring device 1 is inserted into the bored hole 4, or a measurement is made by the measuring part 6. Thereafter, the pressure gauge in the bored hole 4 detects the absolute pressure of underground water between the packers 9, 10, and sends the data to the ground surface through a cable. The pressure detection signal is received at the transmitter/receiver of control system B, and after being converted into a digital signal, is either displayed at the control converter or printed out.

The DC voltage to be supplied to the motor 37 is either increased or decreased by the voltage controller, so the pressure read on the pressure gauge P stays at the pressure center value $P_o$ and within the range set at the permissible variation range $\delta P$ ($P_o-\delta P$ to $P_o+\delta P$).

In other words, as shown in FIG. 7, when $P<P_o+\delta P$, the voltage is kept where it is, but when $P<P_o-\delta P$, the voltage is raised slowly until $P=P_o$. And when $P>P_o+\delta P$, the voltage is slowly lowered until $P=P_o$. This judgment is made in the control converter in the control system B, and the result is sent as a command to the voltage controller to either increase or decrease the voltage.

Using this embodiment, because the motor 37 driving the pump 7 is controlled so that the pressure between the packers 9, 10 is kept constant, the volume of underground water flowing in across the packers 9, 10 and the volume of underground water pumped up by the pump can be balanced. This eliminates the possibility that the pressure of the underground water in the space partitioned by the packers 9, 10 develops a sudden pressure change because of water pumped up by the pump 7, resulting in no change of values for $O_2$ and $CO_2$ dissolved in the underground water.

Figure 8:
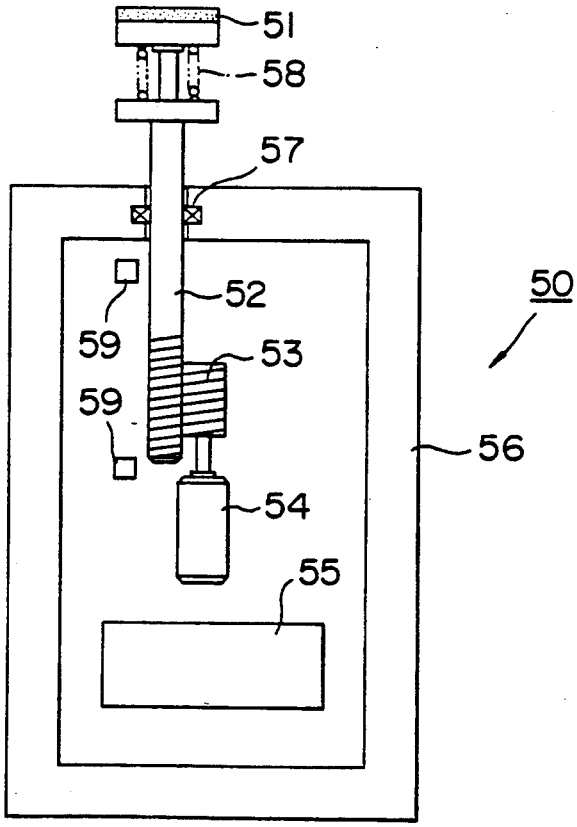
FIG. 8 is a drawing of the device of a third embodiment of the present invention. This drawing is an expanded view of the washing mechanism.

Next, FIG. 8 shows a third embodiment of the present invention, a device for measuring the properties of underground water. The measuring device in this embodiment is structured so that, in addition to including the measuring device in the first embodiment, it is disposed with a washing mechanism 50 to wash the surface of the property value measuring sensor in the measuring part 6.

As shown in FIG. 8, this washing mechanism 50 roughly comprises a grinding member 51 using a ceramic material a disc, for example, a worm wheel 52 to stabilize the rotation of the grinding member around its center shaft, a worm gear 53, a drive motor 54 to be coupled with the worm wheel 52 to give it a driving force, and a control circuit 55 to control the driving rate of the drive motor 54.

The drive motor 54, the control circuit 55, and the lower end of the worm wheel 52 are covered by a casing 56 that is nearly sealed. On the upper part of this casing 56 is a bearing 57 that contacts the worm wheel 52 closely while stabilizing its rotation. Inside the casing 56 and beside the worm wheel 52 are two position detection sensors 59. The grinding member 51 is pressed to the upper part of the worm wheel 52 by a spring 58. The washing mechanism 50 is arranged in the lower part of the sensor electrode section (not shown) in the measuring part 6.

When using the washing mechanism 50, the grinding member 51 is operated appropriately to remove impurities deposited or precipitated on the sensor. Particularly, at great depths where a more protruding force for the grinding member 51 is required, a driving system using two drive motors may be used.

The measuring device 1 of this embodiment makes it possible to remove sulfides and other substances deposited or precipitated on the sensor during the measurement of underground water properties in the bored hole 4, by means of operating the washing mechanism 50. The operation maintains good sensor sensitivity and provide accurate property values because the sensor surface can be kept clean at all times by using the washing mechanism 50. This is true even if the underground water in the bored hole is rich in constituents, such as sulfide and the like, that may deposit, precipitate on or corrode the pH sensor or electrode of the oxidation-reduced potential sensor. The electrode tip will become slightly shorter when ground, but no impediment will result since it can be adequately adjusted by the spring 58 in the grinding member 51. Thus, when the washing mechanism 50 of this embodiment is used, the sensor surface can be maintained in top condition at all times.

Figure 9:
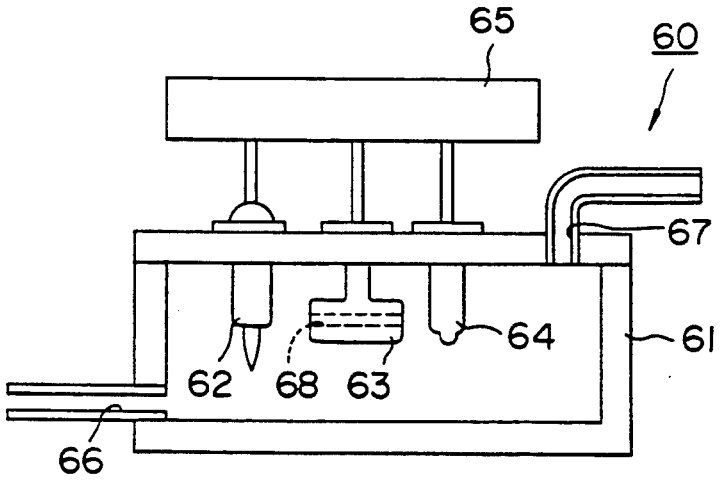
FIG. 9 is a drawing of the device of a fourth embodiment of the present invention. This drawing is an expanded view of a measuring part on the ground surface.

Next, FIG. 9 shows a fourth embodiment of the present invention, a device for measuring the properties of underground water. The measuring device 1 in this embodiment is structured so that, in addition to including the measuring device in the first embodiment, it has a second measuring part 60 on the ground. The measuring part 60 roughly comprises a main measuring part 61 where the underground water pumped up by the pump 7 flows in and gets discharged, and a measuring circuit 65 from which sensors 62, 63, 64 protrude into the main measuring part 61.

The main measuring part 61 forms an enclosed box-like container and has a suction hole 66 on the lower end to one side through which the pumped underground water flows. The measuring part also has on the upper part of the opposite side a discharge hole 67 through which the underground water flown from the suction hole 66 is discharged. The shape and cubic volume of the main measuring part 61 is determined from its relationship with the pumping volume of the pump 7, and is configured so that the underground water flows easily and the main part 61 is as small as possible. It is best to build the main part 61 out of a transparent material so that its interior can be seen.

The sensors 62, 63, 64 extending from the measuring circuit 65 is arranged so that they pierce through the top of the measuring main part 61 and their tips protrude into the main part 61. In this case, the sensors 62, 63, 64 are arranged so that they provide more precise measurements. That is, because water temperature and conductivity are close relation with each other, the parts measuring these values are arranged as close together as possible. A hole 68 in the center of the conductivity sensor 63 is drilled in a direction that makes it easy for the underground water to flow. The electrode sensors (pH, ORP) that may have internal liquid creep out are preferably arranged downstream from the underground water flowing direction.

Therefore, the measuring device 1 of this embodiment is capable of enhancing the reliability of measurements of underground water properties by comparing the property values measured in the measuring part 6 in the bored hole 4 with the property values of underground water pumped up by the pump 7 and measured by the measuring part 60 on the ground.

Figure 10:
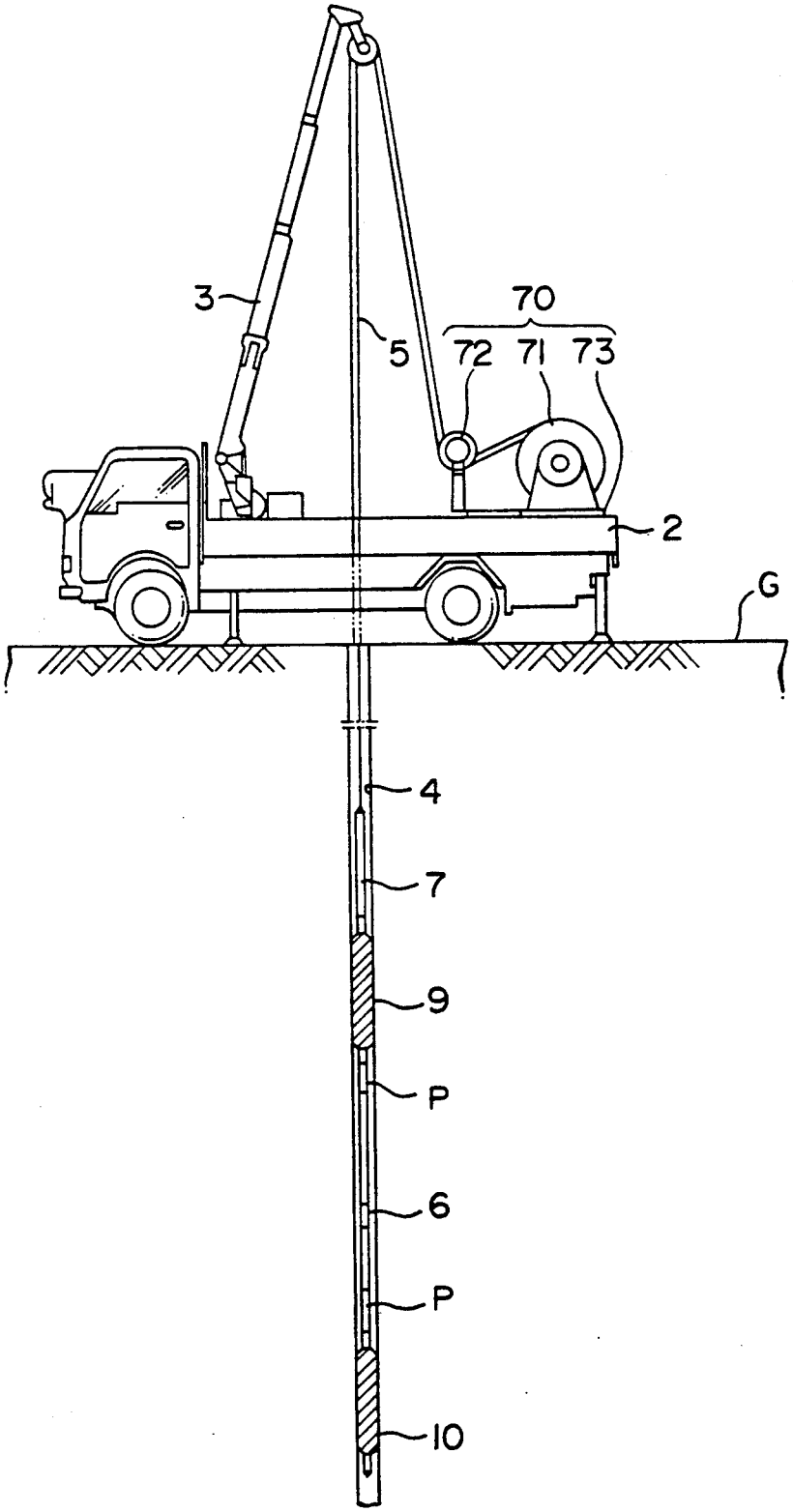
FIG. 10 is a cross-sectional drawing of the entire configuration of the device of a fifth embodiment of the present invention.

Next, FIG. 10 shows a fifth embodiment of the present invention, a device for measuring the properties of underground water. The measuring device in this embodiment is structured so that, in addition to the having measuring device in the first embodiment, it has a cable measuring device 70 to measure the length of a cable 5 to draw out the measuring device 1 and to determine exactly the depth that the measuring part 6 reaches.

As shown in FIG. 10, the cable measuring device 70 comprises a winch drum 71 to wind the cable 5, a measuring pulley 72 located near the winch drum 71, and a base stand 73 to stabilize the winch drum 71 and the measuring pulley 72.

When using measuring device 1 to take measurements, the cable 5 is wound around the winch drum 71 using a measuring pulley 72, and the cable 5 is drawn out. The number of rotations of the measuring pulley 72 is summed up either by a display or by calculation to get the cable length. Also, the number of rotations of the measuring pulley may be differentiated to calculate the draw-out speed of the cable 5.

Furthermore, the depth position of the measuring part 6 may be calculated using the data from the pressure sensor in the measuring part 6, the result of which is compared to the depth position calculated by the cable measuring device 70 to get an exact depth position.

The device of the present invention is not limited to the above-mentioned embodiments, but may include other configurations. For example, the structure of the measuring parts 11 through 15 is only one possibility, and any other measuring part that can measure other desired properties may be added, or any of the measuring parts through 15 may be deleted optionally.

In addition, the pump 7 may be placed between the upper packer and the lower packer. Furthermore, the configuration of the suction stop valve and the discharge stop valve in the pump 7 is not limited to the one described in the above embodiments, and stop valves already known and conventionally used are also suitable. However, if arranging a pair of stop valves by forming the through-hole in three steps and arranging balls in the steps in the through hole, it is preferable to first drill a through-hole of small diameter, then widen the diameter gradually from one end of the through hole to form a through-hole with three steps. This will make it easier to form the stop valve. In addition, while the piston rods in the above embodiments protrude from both upper and lower faces of the piston, the piston rod can just as well be coupled to a drive mechanism at one side only. However, placing piston rods both above and below the piston as in the embodiments supports the piston from both above and below, and so makes the piston's reciprocal motion smoother and the discharge volume more uniform.

While the embodiments use frequencies to transmit the measurement data and control signals, it is also possible to use digital signals using FSK or PSK for transmission. Moreover, any combination of embodiments 1 through 5 may be used.

What is claimed is:

1. A device inserted into a bored hole to measure properties of underground water therein, comprising:

measuring means with a measuring sensor for measuring the properties of said underground water;

a pair of expandable and contractible packers arranged above and below said measuring means respectively;

a water pump for pumping up to the ground surface the underground water flowing into the area partitioned by said packers;

a pressure sensor to detect water pressure around said water pump;

control means to control the pumping rate in accordance with a signal detected by said pressure sensor;

transmitting means for sending measurement signals from said measuring means; and receiving means arranged on the ground for receiving said measurement signals from said transmitting means.

2. A device according to claim 1, wherein said device further comprises a bending means which can be bent in every direction.

3. A device according to claim 1, wherein said device further comprises a second measuring means to measure the properties of said underground water pumped up by said water pump.

4. A device according to claim 3, wherein said measuring means, said packers and said transmitting means are suspended by the same cable.

5. A device according to claim 4, wherein said device further comprises a cable measuring means to measure the length of said cable extending from the ground surface to said measuring means.

6. A device inserted into a bored hole to measure properties of underground water therein, comprising measuring means with a measuring sensor for measuring the properties of said underground water;

a pair of expandable and contractible packers arranged above and below said measuring means respectively;

a water pump for pumping up to the ground surface the underground water flowing into the area partitioned by said packers, the water pump comprising a cylinder, a waterproof piston moving in said cylinder, and a suction/discharge mechanism on both ends of said cylinder;

transmitting means for sending measurement signals from said measuring means; and receiving means arranged on the ground for receiving said measurement signals form said transmitting means.

7. A device according to claim 6, wherein said suction/discharge mechanism comprises of a suction stop valve linked to the inside of said cylinder, which is opened externally only when suction is generated by said piston, and a discharge stop valve also linked to the inside of the cylinder, which is opened externally only when increased pressure is generated by said piston.

8. A device inserted into a bored hole to measure properties of underground water therein, comprising:

measuring means with a measuring sensor for measuring the properties of said underground water;

a pair of expandable and contractible packers arranged above and below said measuring means respectively;

a washing mechanism to wash the surface of said measuring sensor in said measuring means;

transmitting means for sending measurement signals from said measuring means; and receiving means arranged on the ground for receiving said measurement signals from said transmitting means.

* * * * *

UNITED STATES PATENT AND TRADEMARK OFFICE

CERTIFICATE OF CORRECTION

PATENT NO. : 5,189,909

DATED : March 2, 1993

INVENTOR(S) : Takayasu Oike, et al.

It is certified that error appears in the above-identified patent and that said Letters Patent is hereby corrected as shown below:

Column 7, line 58: "Il" should read --11--

Column 11, line 31: after "parts" insert --11--

Column 12, line 44, Claim 6: "form" should read --from--

Signed and Sealed this

Twenty-third Day of November, 1993

*Attest:*

*Attesting Officer*

BRUCE LEHMAN

*Commissioner of Patents and Trademarks*